US005518845A

United States Patent [19]

Rider

[11] Patent Number: 5,518,845

[45] Date of Patent: May 21, 1996

[54] METHOD AND APPARATUS FOR CONTROLLING THE RATE OF REPLENISHMENT OF CHEMICAL SOLUTIONS IN PHOTOGRAPHIC PROCESSING

[75] Inventor: Christopher B. Rider, Mitcham, United Kingdom

[73] Assignee: Eastman Kodak Company, Rochester, N.Y.

[21] Appl. No.: 326,816

[22] Filed: Oct. 20, 1994

Related U.S. Application Data

[63] Continuation of Ser. No. 108,166, Aug. 17, 1993, abandoned, which is a continuation of Ser. No. 730,934, filed as PCT/GB90/00162, Feb. 1, 1990, abandoned.

[30] Foreign Application Priority Data

Feb. 1, 1989 [GB] United Kingdom ..... 8902186

[51] Int. Cl.[6] ..... G03C 5/00; G03C 3/00; G03D 13/00; G03D 3/02

[52] U.S. Cl. ..... 430/30; 430/398; 430/399; 430/400; 354/297; 354/298; 354/324; 355/27

[58] Field of Search ..... 430/30, 398, 399, 430/400; 354/298, 299, 324; 355/27

[56] References Cited

U.S. PATENT DOCUMENTS

| | | | |
|---|---|---|---|
| Re. 30,123 | 10/1979 | Crowell et al. | 354/297 |
| 3,787,689 | 1/1974 | Fidelman | 354/298 |
| 3,905,698 | 9/1975 | Schroter et al. | 354/298 |
| 4,081,280 | 3/1978 | Corluy et al. | 430/30 |
| 4,642,276 | 2/1987 | Burtin | 430/30 |
| 4,881,095 | 11/1989 | Shidara | 355/27 |

FOREIGN PATENT DOCUMENTS

| | | | |
|---|---|---|---|
| 1522884 | 10/1969 | Germany . | |
| 3220169 | 12/1983 | Germany | 354/298 |
| 61-275757 | 12/1986 | Japan | 354/297 |

OTHER PUBLICATIONS

English translation of Japanese Patent 61–275757 Published Dec. 5, 1986.

Jones et al., "Control of Photographic Printing by Measured Characteristics of a Negative", 32 J. of Optical Soc. of Am. 558, 558–619, (1942).

Patent & Trademark Office English Language Translation of German Patent 1,522,884 (Pub. Oct. 16, 1969).

*Primary Examiner*—George F. Lesmes
*Assistant Examiner*—Bernard P. Codd
*Attorney, Agent, or Firm*—Nixon, Hargrave, Devans & Doyle

[57] ABSTRACT

A method and apparatus for controlling the rate of replenishment of chemical solutions in a photographic processing apparatus used for copying a photographic negative having a transmittance onto photographic material includes a number of steps and an apparatus for carrying out those steps. First, light is exposed onto the photographic negative to form a latent image of the photographic negative on the photographic material. Next, the latent image formed on the photographic material is developed by placing the photographic material in chemical solutions. The photographic material reacts with the chemical solutions to form an amount of dyes on the developed photographic material. The exposure given to the photographic material is measured and then the amount of dyes on the developed photographic material is obtained from the measured exposure. A signal related to the measured exposure given to the photographic material is generated and the signal is used to control the replenishment rate of the chemical solutions, wherein the generated signal which establishes the replenishment rate is directly related to the amount of dyes on the developed photographic material.

14 Claims, No Drawings

METHOD AND APPARATUS FOR CONTROLLING THE RATE OF REPLENISHMENT OF CHEMICAL SOLUTIONS IN PHOTOGRAPHIC PROCESSING

This is a continuation application Ser. No. 08/108,166, filed Aug. 17, 1993, now abandoned, which is a continuation of application Ser. No. 07/730,934, filed Jul. 30, 1991, now abandoned.

The present invention relates to the replenishment of chemical solutions used in the processing of photographic materials.

In a photofinishing laboratory, one of the problems which must be overcome if quality standards are to be maintained concerns the drift in the sensitometry of processed photographic materials.

One cause of such drift is incorrect replenishment of chemicals. As the chemicals in the processor baths are used up, replenishment chemicals must be added to the baths in order to keep the activities and concentrations of the chemicals constant.

Most modern paper processors use detectors at the input to measure the area of paper passing into them. Replenishment rates can then be derived assuming that, on average, the paper has been exposed to a mid-grey. This assumption is reasonable, considering that most printers use an "integrate-to-grey" system.

Many modern printers, however, also have colour correction levels different from 100% and slope correction, which together will cause deviations from the "integrate-to-grey" assumption. These density and colour-balance deviations may not significantly affect the operation of a processor with baths containing large volumes of chemicals. However, a small processor would be more susceptible to drift due to replenishment rates not compensating for the amount of dye formed on the paper being processed. At this point an operator would take steps to bring the processor back to aim.

GB-A-2111726 describes a system for controlling the addition of replenisher to a bath in which light-sensitive media are being processed. The signal controlling the rate of addition of replenisher chemicals is derived from the area of the light-sensitive media which has been scanned by a laser exposing device.

It is therefore an object of the present invention to provide an improved method of controlling the rate of addition of replenisher chemicals to a photographic processor.

In accordance with the present invention, there is provided a method of controlling the rate of replenishment of chemical solutions used in photographic processing apparatus, the apparatus including photographic printing apparatus for copying an object on to photographic material, the method being characterized by the steps of deriving a signal which is related to the measured exposure given to the photographic material, and using the signal to control the replenishment rate of the processing solutions wherein the signal is transmitted to the processing apparatus by a direct data link.

Preferably, the derived signal produces a replenishment rate which is directly related to the amount of image-producing substances formed on the photographic material after development of an image of the object.

Advantageously, the derived signal produces a replenishment rate which exactly balances the chemicals depleted in processing the photographic material.

Photographic processors are normally set up so that the replenishment rate exactly compensates for the chemicals used in processing paper which has been exposed to an predefined average grey level. This grey level is intended to simulate the amount of dye produced on a paint made from the average (population centre) customer negative. It is usual to calibrate the printer with such a population centre negative which is printed to produce a grey print at the average grey level. The printer is adjusted so that the correct density is produced on the grey print.

Having calibrated the printer in this way, the factory calibration of the replenishment system of the processor will also be correct since the average of all prints will turn out to be the average grey level produced by the printer calibration.

The notion of a population centre negative is a useful although fictitious one, since there are always large statistical fluctuations in the negatives submitted by customers. As mentioned earlier, for large volume machines, fluctuations will give rise to little concern. For machines with very small tank volumes, however, this will not be true.

In the following discussion, a method for replenishing photographic developer solution will be described as a particular example. However, this method could be applied to any process where the chemicals are used up according to some function of the amount of exposure given to the material, rather than by the area of exposed material being processed. The equations derived below may need to be modified according to the exact nature of the process involved.

A colour photographic material has three image forming layers: the cyan, magenta and yellow. Light is projected through the film on to the paper to form a latent image which is rendered visible by the processing solutions. Dye is formed by the reaction of developer molecules which have been oxidised by the reduction of silver halide to silver metal with couplers incorporated into the paper. We define the efficiency of dye formation as the average amount of developer molecules which are used up in forming one molecule of the dye. In photographic paper, typically one oxidised developer molecule is used to form a dye molecule. In practice, the number of developer molecules used up may be more than this because not all oxidised developer molecules are converted to dye. Some molecules are lost due to other reactions and processes. Furthermore, the amount of oxidised developer molecules that are lost may vary according to the amount of dye which has already been formed on the paper at any point in the development cycle.

Let the amount of dye formed in the cyan layer of one square foot of paper be c, the amount in the magenta layer be m, and the amount in the yellow layer, y, all in grams. A general expression for the weight of developer replenisher which must be added to the developer tank to replace the developer which has been used to process 1 square foot of colour paper, R, is $$R=k[e_c(c)+e_m(m)+e_y(y)+j(t)]+K \quad (1)$$

where k is s constant of proportionality;

$e_c$, $e_m$, and $e_y$ are functions of the dye amounts c, m and y, respectively representing the amount of developer actually used up in forming the dyes;

j is a function of time, t, and represents the natural process of degradation of the developer by, for example, aerial oxidation, and is dependent on the design of the processor tank; and K is a constant representing the weight of developer carried out of the tank by the wet paper after development.

Consider now an expression for the average amount of replenisher added per square foot of paper assuming that the paper has been exposed to an average grey as described above in relation to printer calibration. The superscript ° is used to denote an average. In the following expression, therefore, R° is the average amount of replenisher which is added per square foot of paper.

$$R^\circ = k[e_c(c^\circ)+e_m(m^\circ)+e_y(y^\circ)+j(t)] + K \quad (2)$$

By subtracting equation (2) from equation (1), we obtain the following expression for the difference in replenisher, δR, which must be added compared to the average amount to correct for variations in the dye amounts for each square foot of paper entering the printer, $$\delta R = k[e_c(c)+e_m(m)+e_y(y)] - K^\circ \quad (3)$$

where $$K^\circ = k[e_c(c^\circ)+e_m(m^\circ)+e_y(y^\circ)] \quad (4)$$

K° is a known quantity and is a recommended figure by manufacturers of photographic products. For machines with large tank volumes, there will be as many prints with dye amounts less than the average than with dye amounts above the average. Developer efficiency is therefore unaffected by these fluctuations in print dye amount. Small volume machines, however, would benefit from being able to calculate δR and vary the replenisher rates accordingly. There are several ways of calculating δR, but none is perfectly accurate.

It is the object of the present invention to describe the principles involved and techniques which could be used to determine δR, as opposed to the exact detail of formulae etc. It should also be borne in mind that the average replenishment rate assumption currently in use is extremely effective. This invention provides a small correction to this technique and absolute accuracy is therefore unnecessary, though accuracy becomes increasingly important as tank volume is reduced. A further complexity which should be understood is that the exact nature of the functions for developer utilisation in dye formation will vary between different manufacturers' papers.

The simplest approach to this problem is an empirical one. Most photofinishing printers work on the "integrate-to-grey principle" (see 'The Reproduction of Colour', 4th Edition, Fountain Press, Hunt R. W. G., at section 16.7 on page 294) or a more sophisticated variant of it. In essence this means that the printer tries to print each negative to produce the same amount of dye on the print, though some more sophisticated exposure determination algorithms may diverge from this when printing "difficult" negatives like snow scenes or fireworks shots. It is possible to override this tendency by using a manual correction to the exposure time. The corrections are usually defined in terms of "density button" units where each button adds a fixed increment to the exposure time, typically 19%. Thus a '+3 button' correction increments the time by 1.19×1.19×1.19 or 1.68. A '−4 button' change decreases the time by 1.19×1.19×1.19×1.19 or 2 (a halving of the time). The exact increment is usually variable and can be set up by the user.

If the amount of replenisher which must be added to the developer tank per square foot of paper printed normally (without manual correction) is known, it is possible to calculate the amount of dye which will be formed on a print which has been corrected for density. The calculation is not trivial and will be addressed later. It is nevertheless possible, whether by experiment or by calculation, to assign to each correction button, an adjustment to the replenishment rate according to the difference in dye formed on the print. This is equivalent to solving equation (3) above at discrete values of c, m and y. For example, we might find that, on average, for a +4 correction to a print, there is 1.75 times as much dye produced in each of the three layers as for a normal print. Thus 1.75 times as much replenisher would need to be added as for a normal print.

In this way the replenishment rate may be varied without the need for complicated calculations. Implementation is therefore cheap and simple, requiring only the use of a lookup table referencing δR to each correction button. The same principle may also be applied to the colour correction buttons, though it should be understood that the functions representing developer usage for dye amount produced may not be the same for each layer.

More sophisticated printer algorithms may permit much smaller increments in density and colour balance. In these cases, it may be possible to perform a calculation to get values for δR rather than having to perform many experimental determinations. Again, the exact details of the calculation will vary from machine to machine so the general outline will be explained below, where the assumption is made that an average measurement of the negative transmittance has been made (rather than discrete measurements at many places on the negative). This average can represent the average transmittance of the entire object to be copied. Alternatively, the average can represent an average of the transmittances of a plurality of different small areas on the object or an average of a random sample of a large number of objects to be copied.

Each printer has some form of exposure determination algorithm whose output is an exposure, $E_i$, to each of the three layers (i=c, m and y) of a photographic paper relative to some calibration setting, $E^\circ_i$.

There is a well known relation between exposure and optical reflection density, $R_{Di}$, known as the $R_D$–log(E) curve for each layer of the paper which can be used to calculate the optical density of the print in each layer. This relation is discussed in 'The Theory of the Photographic Process', 4th edition, Mees C. E. K. and James T. H., page 529.

The next step is to convert from reflection density to transmission density using another well known relation (see Williams and Klapper, Journal of the Optical Society of America, 1953, volume 43, page 595). It is now possible to obtain relative dye amounts on the print to a good approximation by taking the ratio of the transmission densities of the print in question, $T_{Di}$, to the transmission density of the calibration print, $T^\circ_{Di}$. We may therefore write for the magenta layer for example, $$\frac{m}{m^o} = \frac{T^o_{Di}}{T_{Di}} \quad (5)$$

If the contribution from the magenta layer to the total replenishment needed for the print is $R_m$ and that for the calibration print is $R^\circ_m$, then we may write, $$\frac{R_m}{R^o_m} = \frac{T^o_{Di}}{T_{Di}} \quad (6)$$

and more generally, $$\delta R_i = R^o_i\left(\frac{E^o_i}{E_i} - 1\right) \quad (7)$$

In equation (7), we have a relationship between the correction to the replenishment rate and the transmission density of the print, which is a function of $E_i$, the exposure given to the print. The functional relationship between $T_{Di}$ and $E_i$ is found from a knowledge of the paper's $R_D$–log(E) curve, and the $R_D/T_D$ curve as is described in detail by Williams and Klapper mentioned above. It is preferable to combine these two curves into a single function, which may be a table of pairs of values relating $E_i$ and $T_{Di}$. Intermediate points may, of course, be found by interpolation. Once again, it is important to note that the $\delta R_i$ term will normally be a small correction to $R_i$ and therefore a high degree of accuracy is not required to establish the relationship between $E_i$ and $T_{Di}$.

Ideally, different values for $R_i$ and the relationship between $E_i$ and $T_{Di}$ would be used for each manufacturer's paper, but in practice this would not be necessary on account of the nature of the small difference it would make to the performance of a replenishment system. This is further emphasized by the fact that most replenishment pumps are not capable of delivering liquid with a high degree of accuracy.

Photofinishing printers work in one of three ways. Some expose one print at a time and immediately send each exposed print to a processing machine. Others expose small batches of prints (typically between five and thirty prints) which are sent in one long length to the processing machine. These first two types of printer are normally found in minilabs where the printer is directly connected to a processor. There are still other types of printer which expose very large batches of prints, typically many hundreds, on to long rolls of paper before being taken uncut to a separate processing machine. These types of printers are normally found in high volume photofinishing establishments.

If the printer is of the high volume type, the replenishment data would need to be recorded on a magnetic storage medium, such as a floppy disc. When the roll of photographic paper has been exposed and loaded into the paper processor, the floppy disc would then be loaded into the paper processor's own floppy disc drive. The paper processor, equipped with a microprocessor controlled replenishment system, would access the replenishment data via its microprocessor as the roll of photographic paper is being processed in a developer. After a fixed number of prints have entered the developer, for example ten, an amount of replenisher would be added to the developer bath and an equal amount of developer drained off. The amount added would correspond to the sum of the replenisher amounts for the particular ten prints in the developer. The replenishment rate of the processing solutions is controlled by a signal related to the measured exposure given to the photographic material, wherein the signal is derived from the average of measurements of the average transmittance of a large random sample of all objects copied onto the photographic material.

It is common practice for holes or notches to be punched by the printer on to the roll of photographic paper between prints, for use by an apparatus which chops the paper into individual prints. The paper processor would count these holes or notches to know how many prints had entered it.

The replenishment information for each print may also be recorded on the print itself by means of a machine-readable code applied to the back of the print. Alternatively, the information may be encoded as a series of punched holes between prints.

Photographic printers which only use discrete photocells for determining exposure measure only the average transmittance of a negative. A subject comprising a white spot against a black background would print as a black spot on a white background. The black spot would have reached the maximum density the photographic paper could give. The amount of dye in the spot would therefore be less than that expected from a calculation based on the average transmittance of the negative. Consequently, the calculated amount of replenishment required for that print would be too great.

This can be overcome by the use of a higher resolution measurement of the transmittance of the negative. A scanning device, for example a charge-coupled device having a 30 by 20 array, would yield 600 measurements of the transmittance of the negative. Areas of low density on the negative which would give an area of $D_{max}$ on the print could be recognised as such, by using the paper's $R_D$–log(E) curve. The dye amounts formed at each of the 600 areas could be added together to give an accurate calculation of the total dye amount formed on the print.

The ultimate extension of this technique would be to apply it to a scanning printer where the negative is scanned at very high resolution.

The present invention has the advantage that it overcomes the problem of incorrect chemical replenishment, thus reducing sensitometric drift, maintaining quality and therefore saving money.

The present invention would be particularly suited to a small photofinishing operation such as a mini-lab where small chemical volumes in the processing tanks increase the susceptibility of the photographic processor to the effects of incorrect replenishment. Furthermore, for the small photofinishing operation, the relatively low hardware cost required to incorporate the present invention in a printer-processor pair is an added advantage. In addition, the need for a storage medium on which to retain the dye amounts calculated for the prints from a given roll of negatives during printing would be eliminated as the microprocessors in both the printer and the processor would be able to transfer the data between them.

It is particularly expected that the embodiment of the present invention describe above wherein the replenishment rate is linked to the density and colour correction buttons would be ideally suited to a minilab where implementation costs would need to be kept to a minimum.

The invention is particularly suited to the replenishment of photographic developers, but could be used with any apparatus where the replenishment rate is a function of the exposure given to the material.

I claim:

1. A method of controlling the rate of replenishment of chemical solutions in a photographic processing apparatus used for copying a photographic negative having a transmittance onto photographic material, the method comprising:

exposing light onto the photographic negative to form a latent image of the photographic negative on the photographic material;

developing the latent image formed on the photographic material by placing the photographic material in said chemical solutions, the photographic material reacting with said chemical solutions to form an amount of dyes on the developed photographic material;

measuring the exposure given to the photographic material;

obtaining the amount of dyes on the developed photographic material from the measured exposure;

generating a signal related to the measured exposure given to the photographic material; and using said signal to control the replenishment rate of said chemical solutions;

wherein the generated signal which establishes the replenishment rate is directly related to the amount of dyes on the developed photographic material.

2. The method according to claim 1, wherein the generated signal related to the measured exposure is generated from measurements of average transmittance of the photographic negative.

3. A method according to claim 2 wherein a plurality of photographic negatives are copied and the generated signal is obtained from an average of measurements of the average transmittance of a random sample of all photographic negatives copied onto the photographic material.

4. The method according to claim 1, wherein the generated signal related to the measured exposure is generated from measurements of an average of transmittance of a plurality of different small areas of the photographic negative.

5. A method according to claim 4 wherein a plurality of photographic negatives are copied and the generated signal is obtained from an average of measurements of the average transmittance of a random sample of all photographic negatives copied onto the photographic material.

6. A method according to claim 1 wherein the replenishment rate is adjusted in discrete steps to adjust the levels of density and/or color correction used in the process of copying the photographic negative.

7. A method according to claim 6 wherein the density and/or color correction is/are directly linked to increments or decrements in the replenishment rate to the chemical solution in the photographic processing apparatus.

8. A photographic processing apparatus, including a printing apparatus, for copying a photographic negative having a transmittance onto photographic material, the apparatus comprising:

means for exposing light onto the photographic negative to form a latent image of the photographic negative on the photographic material;

means for developing the latent image formed on the photographic material by applying chemical solutions to said photographic material, the photographic material reacting with said chemical solutions to form an amount of dyes on the developed photographic material;

means for measuring the exposure given to the photographic material;

means for generating a signal related to the exposure given to the photographic material; and means for using said signal to control the replenishment rate of said chemical solutions;

wherein the generated signal which establishes the replenishment rate is directly related to the amount of dyes on the photographic material.

9. Apparatus according to claim 8, wherein the signal is transmitted to the processing apparatus by a direct data link.

10. Apparatus according to claim 8, wherein the printing apparatus is provided with means for recording replenishment data on the photographic material and wherein the processing apparatus is provided with means for reading the recorded data.

11. Apparatus according to claim 8, wherein the printing apparatus and processing apparatus are provided with storage means and wherein data relating to the signal is first stored on a storage medium in the printing apparatus which is then transferred to the processing apparatus.

12. Apparatus according to claim 11, wherein the storage medium is a magnetic storage medium.

13. Apparatus according to claim 8 wherein the printing apparatus has a plurality of density and color correction buttons which are directly related to increments and decrements in the replenishment rate applied to the chemical solution in the processing apparatus.

14. Apparatus according to claim 8, wherein the printing apparatus is provided with scanning means for obtaining measurements of the transmittance of a plurality of different small areas of the photographic negative.

* * * * *